US007893825B2

(12) United States Patent
Gonzales

(10) Patent No.: US 7,893,825 B2
(45) Date of Patent: Feb. 22, 2011

(54) ALARM ORIGINATION LATCHING SYSTEM AND METHOD

(75) Inventor: Eric V. Gonzales, Aurora, IL (US)

(73) Assignee: Universal Security Instruments, Inc., Owings Mills, MD (US)

( * ) Notice: Subject to any disclaimer, the term of this patent is extended or adjusted under 35 U.S.C. 154(b) by 274 days.

(21) Appl. No.: 12/274,010

(22) Filed: Nov. 19, 2008

(65) Prior Publication Data

US 2009/0128353 A1 May 21, 2009

Related U.S. Application Data

(60) Provisional application No. 60/989,369, filed on Nov. 20, 2007.

(51) Int. Cl.
*G08B 29/00* (2006.01)

(52) U.S. Cl. ..... 340/506; 340/517; 340/521; 340/522; 340/628; 340/632

(58) Field of Classification Search ..... 340/506, 340/514, 517, 521, 522, 531, 628, 632, 539.14, 340/539.26
See application file for complete search history.

(56) References Cited

U.S. PATENT DOCUMENTS

| | | | | |
|---|---|---|---|---|
| 4,349,812 | A | 9/1982 | Healey et al. | |
| 4,363,031 | A | 12/1982 | Reinowitz | |
| 4,769,025 | A | 9/1988 | Sarstedt et al. | |
| 5,587,705 | A | 12/1996 | Morris | |
| 5,594,410 | A | 1/1997 | Lucas et al. | |
| 5,905,438 | A | 5/1999 | Weiss et al. | |
| 6,078,269 | A | 6/2000 | Markwell et al. | |
| 6,346,880 | B1 | 2/2002 | Schroeder et al. | |
| 6,353,395 | B1 | 3/2002 | Duran | |
| 6,426,703 | B1 | 7/2002 | Johnston et al. | |
| 6,437,698 | B1 | 8/2002 | Byrne et al. | |
| 6,611,204 | B2 | 8/2003 | Schmurr | |
| 6,614,347 | B2 | 9/2003 | Tanguay | |
| 6,624,750 | B1 | 9/2003 | Marman et al. | |
| 6,642,849 | B1 | 11/2003 | Kondziolka | |
| 6,646,566 | B1 | 11/2003 | Tanguay | |
| 6,753,786 | B1 * | 6/2004 | Apperson et al. | 340/628 |
| 6,762,688 | B2 | 7/2004 | Johnston et al. | |
| 7,075,444 | B2 | 7/2006 | Tanguay | |
| 7,091,855 | B2 | 8/2006 | Barrieau et al. | |
| 7,126,487 | B2 | 10/2006 | Kaiser et al. | |
| 7,158,023 | B2 | 1/2007 | Kaiser et al. | |
| 7,242,288 | B2 | 7/2007 | Kaiser et al. | |
| 7,385,517 | B2 | 6/2008 | Andres et al. | |

FOREIGN PATENT DOCUMENTS

| | | |
|---|---|---|
| EP | 1 906 371 A2 | 2/2008 |

* cited by examiner

*Primary Examiner*—Hung T. Nguyen
(74) *Attorney, Agent, or Firm*—Cahn & Samuels, LLP

(57) ABSTRACT

An embodiment of the invention provides a method including detecting a select hazardous condition by at least one triggering alarm unit of a plurality of interconnected hazardous condition alarm units. An actuatable latch in the triggering alarm unit is switched from an unlatched state to a latched state. An audible alert is generated in all of the interconnected alarm units. A test switch is actuated to identify the triggering alarm unit. Actuating the test switch disables the audible alert in each alarm unit having an actuatable latch in the unlatched state. A reset switch is actuated in only one of the alarm units to reset the actuatable latch in each of the alarm units to the unlatched state.

20 Claims, 10 Drawing Sheets

ALARM ORIGINATION LATCHING SYSTEM AND METHOD

This application claims the benefit of U.S. provisional application Ser. No. 60/989,369, filed on Nov. 20, 2007, which is incorporated herein by reference.

I. FIELD OF THE INVENTION

This invention relates to alarm latching technology associated with interconnected hazardous condition alarm units and improvements thereto.

II. BACKGROUND OF THE INVENTION

Numerous systems have been developed that provide a network of alarm units for detecting a hazardous condition. Typically in these systems, the individual alarm units are interconnected to form the network to allow each alarm unit in the network to activate a respective horn when a hazardous condition is detected by any one of the alarm units.

In a network of multiple alarm units, it may be difficult to identify the location of the hazardous condition if a person cannot pinpoint which alarm unit triggered the system. As discussed below, several interconnected alarm systems have been developed that utilize a flashing light source (e.g., light emitting diode (LED)) on the triggering alarm unit to identify the alarm unit that detected the hazardous condition and triggered all of the interconnected alarm units within the network to activate their respective horns.

However, a person may not be able to recognize a flashing light source if the alarm unit is not in the line of sight of the viewer. For instance, a flashing light source can be easily missed by a person if the alarm unit is blocked by walls, ceiling fans, exit signs, or other obstructions. Likewise, a flashing light source may go unnoticed by a person with poor eyesight or if the person has his or her back turned to the alarm unit.

Moreover, in order to identify all of the alarm units that detected the hazardous condition (or to check the alarm units for false alarms), the person must go to every room having an alarm unit to determine whether the flashing light source has been activated. This task is magnified when there are a large number of alarm units in the network. Unless the alarm units are visible from a hallway, a person cannot merely walk down the hallway and look into every room to determine whether the alarm units are flashing a light source.

Another drawback of prior alarm systems is the lack of a quick and efficient means for resetting or clearing the light sources on the alarm units after the alarm unit that triggered the network of interconnected alarm units to activate their respective horns has been identified. Specifically, the light sources can only be reset by manually depressing a reset switch located on each individual alarm unit. The task is magnified when there are a large number of alarm units in the network. In large multi-story buildings having numerous alarm units, a substantial amount of time and effort is needed to reset all of the light sources in the network. A person is required to go to each and every room having an alarm unit therein, and manually reset each individual alarm unit having a flashing light source. Further, it is often difficult and time consuming to manually depress the reset switch on every alarm unit when the alarm units are positioned on or near the ceiling in an effort to detect rising smoke.

U.S. Pat. No. 4,349,812 to Healey is an example of a system having a plurality of alarm units. Each alarm unit is connected to a central control panel that includes a display board having a light source associated with each alarm unit. When an alarm unit detects a hazardous condition, the alarm unit sends a signal that latches an indicator circuit associated with the alarm unit, which in turn activates a light source on the display board for the alarm unit.

A person must physically go to the central control panel and visually check the display board to identify the alarm units that detected the hazardous condition. This may be difficult if the central control panel is not easily accessible (e.g., due to the hazardous condition) or if the person does not know where the central control panel is located within the building. Moreover, in an emergency situation where time is of the essence, it may be difficult to access the central control panel in a timely manner.

U.S. Pat. No. 6,353,395 to Duran provides an example of a network of interconnected alarm units, wherein each alarm unit has a light source that can be manually activated if the alarm unit has detected a hazardous condition. More specifically, a latch within the alarm unit that detected the hazardous condition and triggered all of the interconnected alarm units within the network to activate their horns (referred to herein as the "triggering alarm unit") is set to a latched state when the triggering alarm unit detects a hazardous condition. Subsequently, if a test switch is actuated on the triggering alarm unit, a light source (i.e., pulsed illumination of an LED) is activated on the triggering alarm unit for a predetermined period (e.g., 10 minutes). The light source requires manual activation of the test switch on the triggering alarm unit to identify whether the alarm unit has detected the hazardous condition. Thus, a person must test each individual alarm unit in the network in order to identify all of the alarm units that triggered the network alarm. In a large building, a considerable amount of time and effort may be required before a single triggering alarm unit is located, even if the user chooses not to test every alarm unit in the building. In order to reset all of the latches in the network, the reset switch in each and every triggering alarm unit must be pressed. As such, the person must reset each individual alarm unit to ensure that all of the latches within the network are reset.

U.S. Pat. No. 7,075,444 to Tanguay discloses a network of alarm units connected by an interconnect line. When a hazardous condition is detected by the triggering alarm unit, a signal is sent through the interconnect line causing all of the alarm units in the network to sound their horns and/or flash their light sources. During the alarm condition (i.e., when the hazardous condition is being detected), an alarm origination test can be performed to identify the triggering alarm unit. Upon actuation of a test switch on any of the interconnected alarm units, the alarm origination test disables the horns and/or flashing light sources on all of the alarm units except for the alarm unit that is currently sensing the hazardous condition.

More specifically, the alarm origination test disables the interconnect line between the triggering alarm unit and the non-triggering remote alarm units. Thus, only the horn/light source on the alarm unit actually detecting the hazardous condition remains active. The horn/light source on the triggering alarm unit is only active when presently "sensing" the hazardous condition. As such, the triggering alarm unit can only be identified when the hazardous condition is present. It is advantageous to have the capability of latching a hazardous condition detection event into memory and subsequently testing the alarm units after the hazardous condition has been eliminated. The alarm units of Tanguay '444 do not include internal memory that latches upon detection of the hazardous condition, wherein the triggering alarm unit is identified based on the latched memory. Moreover, a means for resetting or clearing memory in the alarm units is not provided. Many of the features discussed above conform with established regulations and standards, e.g., Underwriters Laboratory Specification (UL) 217.

III. SUMMARY OF THE INVENTION

It is, therefore, an object of the present invention to provide a new, novel, alarm latching technology for interconnected hazardous condition alarm systems.

It is another object of the invention to address and overcome problems existing in prior art interconnected hazardous condition alarm systems.

Another object of the invention is to identify a signal origination alarm unit that triggered the audible alerts by employing on a resettable memory latch.

Still another object of the invention is to provide memory latches in the alarm units forming part of an interconnected alarm unit network, wherein the memory latches are set from an unlatched state to a latched state upon detection of a hazardous condition, thereby distinguishing a triggering alarm unit (latched state) from non-triggering alarm units (unlatched state).

Yet another object of the invention is to provide a test switch in each alarm unit, wherein actuation of the test switch in any of the individual alarm units disables the audible alerts in all of the networked alarm units not subject to alarm memory latch.

Still yet another object of the invention is to provide a reset switch in each alarm unit, wherein actuation of the reset switch in any of the individual alarm units resets the memory latches in all of the networked alarm units to unlatched states.

A final stated, but only one of additional numerous objects of the invention, is to provide a secondary alert different from the audible alert to differentiate an alarm origination test condition (secondary alert) from an emergency alarm condition (audible alert).

These and other objects are satisfied by a selective hazardous condition detector, comprising:

a) means for interconnecting said selective hazardous condition detector to a second selective hazardous condition detector;

b) means for detecting a select hazardous condition;

c) means for generating an alarm signal corresponding to a detected select hazardous condition;

d) memory means for recognizing said alarm signal;

e) latch means switchable between an unlatched state and a latched state, said latched state being established in response to said alarm signal and said latched state existing for a preset time period;

f) means for selectively actuating said memory means and switching said latch means to said latched state; and g) actuatable reset means for resetting the state of said latch means;

h) whereupon actuating said latch reset means switches said latch means from the latched to the unlatched state after said preset time period while switching the latched means to said unlatched state immediately in said second selective hazardous condition detector.

The foregoing and other objects are satisfied by a system comprising at least a first and a second interconnected hazardous condition alarm units, each of said alarm units comprising:

at least one hazardous condition detector;

a horn for generating an audible alert in response to detection of a select hazardous condition by at least one of said alarm units;

a signal communication member for communicating a signal between said at least first and second alarm units, said signal being sent in response to said detection of said select hazardous condition, and said signal causing activation of said horn;

an actuatable latch switchable between an unlatched state and a latched state, said latched state being established in response to said detection of said select hazardous condition;

a test switch switchable between a first position and a second position, said second position disabling a horn of each alarm unit of said alarm units comprising an actuatable latch in said unlatched state; and a reset switch for resetting said actuatable latch in every alarm unit of said alarm units to said unlatched state.

The foregoing and other objects are further satisfied by a method comprising:

a) detecting a select hazardous condition by at least one triggering alarm of a plurality of hazardous condition alarm units;

b) switching an actuatable latch from an unlatched state to a latched state in said at least one triggering alarm;

c) generating an audible alert in said plurality of hazardous condition alarm units;

d) actuating a test switch to identify said at least one triggering alarm, said actuating of said test switch comprising disabling said audible alert in each alarm unit of said plurality of hazardous condition alarm units comprising an actuatable latch in said unlatched state; and e) actuating a reset switch in only one alarm unit of said plurality of hazardous condition alarm units to reset said actuatable latch in each of said plurality of hazardous condition alarm units to said unlatched state.

The foregoing and other objects and advantages will appear from the description to follow. In short, an embodiment of the invention provides alarm origination functionality that informs a person which alarm unit detected the hazardous condition (e.g., smoke and/or carbon monoxide (CO)) and triggered the system to sound. An audible indication is efficacious for identifying the triggering alarm unit. The concept, in at least one embodiment of the invention, involves automatically latching the triggering alarm unit from an interconnected, hazardous condition network to activate an audible alert only on the triggering alarm unit for a predetermined period (e.g., 60 seconds; the predetermined period may be more or less based on the desired preference of the manufacturer or person). In at least one embodiment, the alarm units do not rely on and do not include a flashing light source.

In at least one embodiment of the invention, an alarm origination test is performed by pressing and releasing the test switch. Once released, except for the triggering alarm unit, all of the interconnected alarm units within the network cease to provide any audible and visual alerts. The only alarm unit that emits an audible alert is the triggering alarm unit. The audible alert persists for a specified limited duration, e.g., 60 seconds. If desired, the alarm unit can also have a flashing light source for coordinated visual indication.

For definitional purposes and as applicable, "connected" includes physical, whether direct or indirect, and/or functional, as for example, a plurality of hazardous condition alarm units connected to an interconnect line. Thus, unless specified, "connected" is intended to embrace any operationally functional connection, e.g., wireless.

In the following description, reference is made to the accompanying drawings, and which is shown by way of illustration to the specific embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

Given the following detailed description, it should become apparent to the person having ordinary skill in the art that the invention herein provides a network of interconnected alarm units, wherein a triggering alarm unit switches an internal actuatable latch from an unlatched state to a latched state when a hazardous condition is detected. The triggering alarm unit sends a signal to all of the interconnected alarm units to active their respective horns. The triggering alarm unit can be identified by disabling the horns on all of the alarm units that do not have an actuatable latch in the latched state (i.e., all of the non-triggering alarm units). Thus, only the horn on the triggering alarm unit remains active. The actuatable latches can be reset to an unlatched state by pressing a reset switch in any of the individual alarm units.

IV. BRIEF DESCRIPTION OF THE DRAWINGS

V. DETAILED DESCRIPTION OF THE PREFERRED EMBODIMENT

The novel features which are believed to be characteristic of the present invention, as to its structure, organization, use and method of operation, together with further objectives and advantages thereof, will be better understood from the following discussion.

Figure 1:
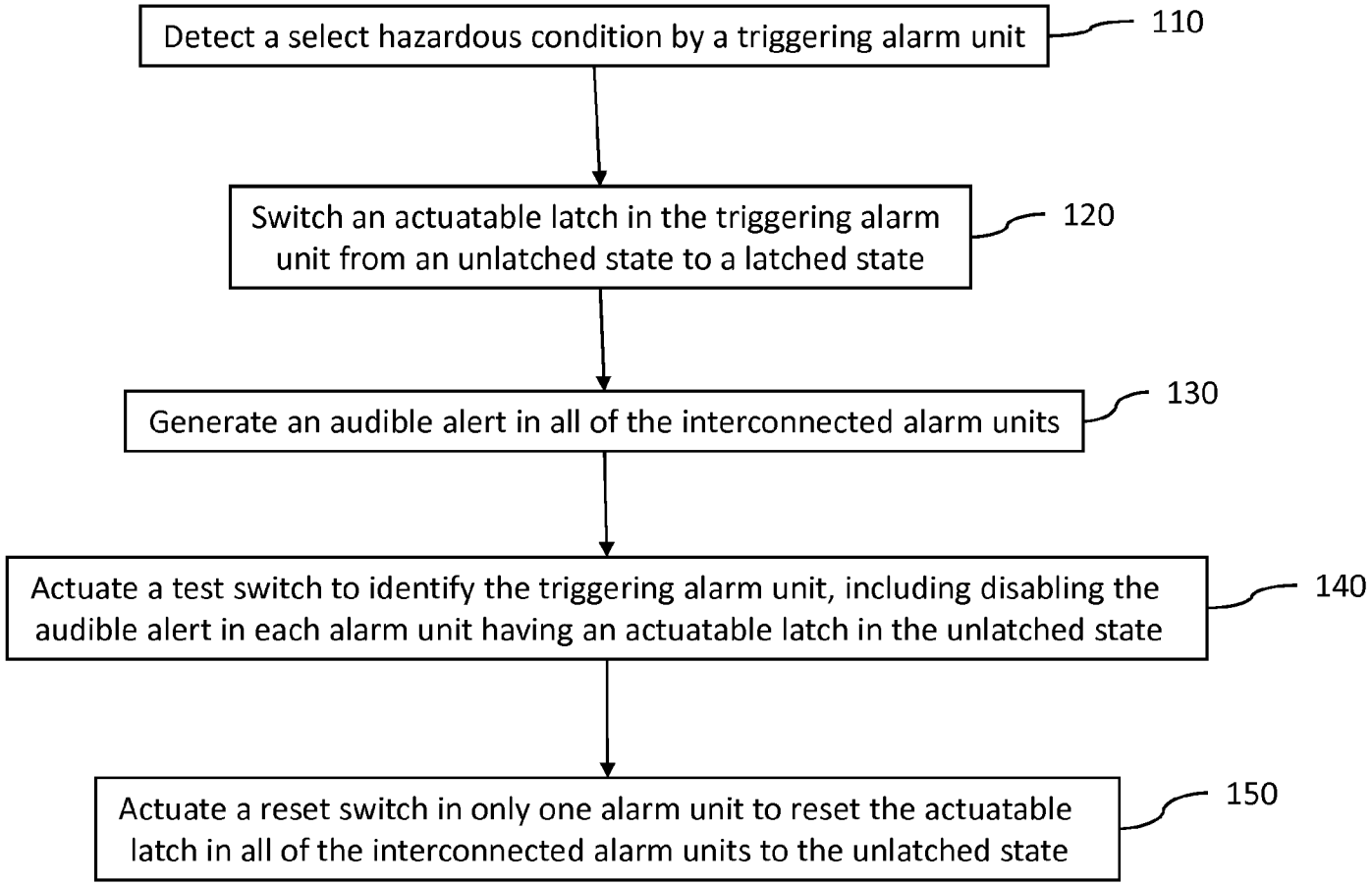
FIG. 1 is a flow diagram illustrating a method according to an embodiment of the invention.

FIG. 1 illustrates a flow diagram of a method according to an embodiment of the invention. The method detects a select hazardous condition, such as smoke and/or CO, by at least one triggering alarm unit in a network of interconnected hazardous condition alarm units (210). As described below, a system is provided having a plurality of hazardous condition alarm units (also referred to herein as "alarm units") connected by an interconnect line.

In response to the detection of the select hazardous condition, the method switches an actuatable latch in the triggering alarm unit from an unlatched state to a latched state (220) and generates an audible alert in all of the interconnected hazardous condition alarm units (230). Examples of audible alerts include horns, bells, and/or buzzers. Different types of audible alerts may be generated to differentiate between the detection of smoke and the detection of CO. Alternatively, when allowed by regulation and/or standard, different patterns and/or different frequencies of the same type of audible alert may be utilized to differentiate between the detection of smoke (e.g., low frequency horn) and the detection of CO (e.g., high frequency horn).

In at least one embodiment, the audible alert is generated in the alarm units by sending an alert signal from the triggering alarm unit through the interconnect line to the connected alarm units. In response to receiving the alert signal, the audible alert is activated in all of the hazardous condition alarm units. The audible alert is maintained in the triggering alarm unit even after the select hazardous condition has been eliminated. The audible alert is disabled in the non-triggering alarm units after the select hazardous condition has been eliminated.

During an alarm origination test, a switch providing a test functionality (test switch) is actuated in order to identify the triggering alarm unit (240). Actuation of the test switch disables the audible alert in each interconnected hazardous condition alarm unit having an actuatable latch in the unlatched state (i.e., the non-triggering alarm units). Actuation of the test switch does not affect the audible alert in the alarm unit having an actuatable latch in the latched state (i.e., the triggering alarm unit). Thus, because the triggering alarm unit switches its actuatable latch to the latched state after detecting the hazardous condition, the audible alert in the triggering alarm unit is not disabled by actuation of the test switch (which only disables alarm units having actuatable latches in the unlatched state). The audible alerts in the non-triggering alarm units are disabled for a predetermined period of time (e.g., 10 minutes). However, as required by applicable standards, e.g., UL 217, the alarm origination test does not prevent a non-triggering alarm unit from generating an audible alert and switching its actuatable latch to the latched state if that alarm unit detects a hazardous condition during the alarm origination test.

A switch providing a reset functionality (reset switch) is actuated in only one of the interconnected alarm units to reset the actuatable latch in each and every alarm unit in the network to the unlatched state (250). Thus, a person is not required to reset each alarm unit individually; resetting any one of the interconnected alarm units resets the actuatable latches in all of the interconnected alarm units. As described below, a single switch or button could function as both the test switch and the reset switch, depending on, for example, how long the switch is depressed.

In another embodiment, a visual alert is generated in the hazardous condition alarm units. For example, a strobe light and/or flashing LED is activated on all of the interconnected alarm units simultaneously with the generation of the audible alert. The visual alert is disabled in each alarm unit having an actuatable latch in the unlatched state (i.e., the non-triggering alarm units) by actuation of the test switch. The test switch does not affect the visual alert in the alarm unit having an actuatable latch in the latched state (i.e., the triggering alarm unit).

In yet another embodiment, the method generates a secondary alert different from the audible alert in all of the interconnected hazardous condition alarm units. The secondary alert is disabled in each alarm unit having an actuatable latch in the unlatched state (non-triggering alarm units). For example, upon detecting a hazardous condition, the interconnected alarm units of the network sound a horn in a specific audible pattern (audible alert). During the alarm origination test, all of the interconnected alarm units sound the horn in a different pattern or generate a discrete digitized sound, such as a bell (secondary alert), wherein the secondary alert in the non-triggering alarm units are subsequently disabled. The secondary alert is utilized to distinguish an alarm origination test (secondary alert) from an emergency alarm condition (audible alert).

Figure 2:
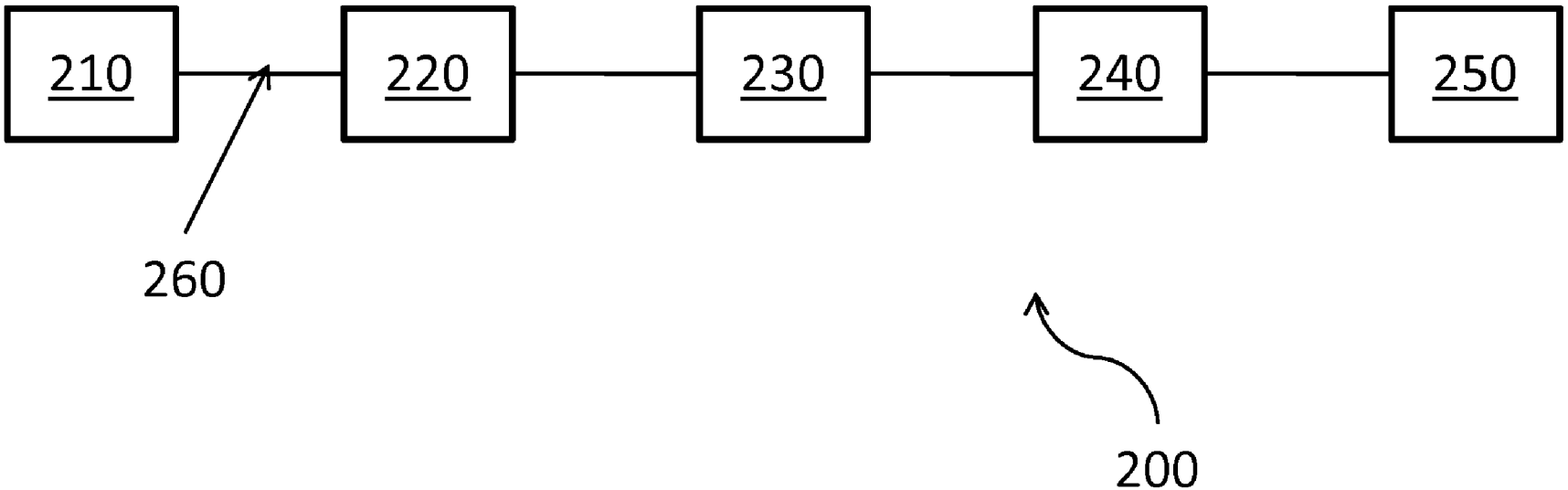
FIG. 2 is a diagram illustrating a system having a network of interconnected hazardous condition alarms according to an embodiment of the invention.

An embodiment of the invention provides a system 200 having a network of interconnected hazardous condition alarm units 210, 220, 230, 240, and 250 connected by an interconnect line 260. For example, a preferred embodiment of the system 200 is illustrated in FIG. 2. Although FIG. 2 illustrates the alarm units connected serially, other configurations are possible, such as hub and spoke or web configurations.

Figure 3:
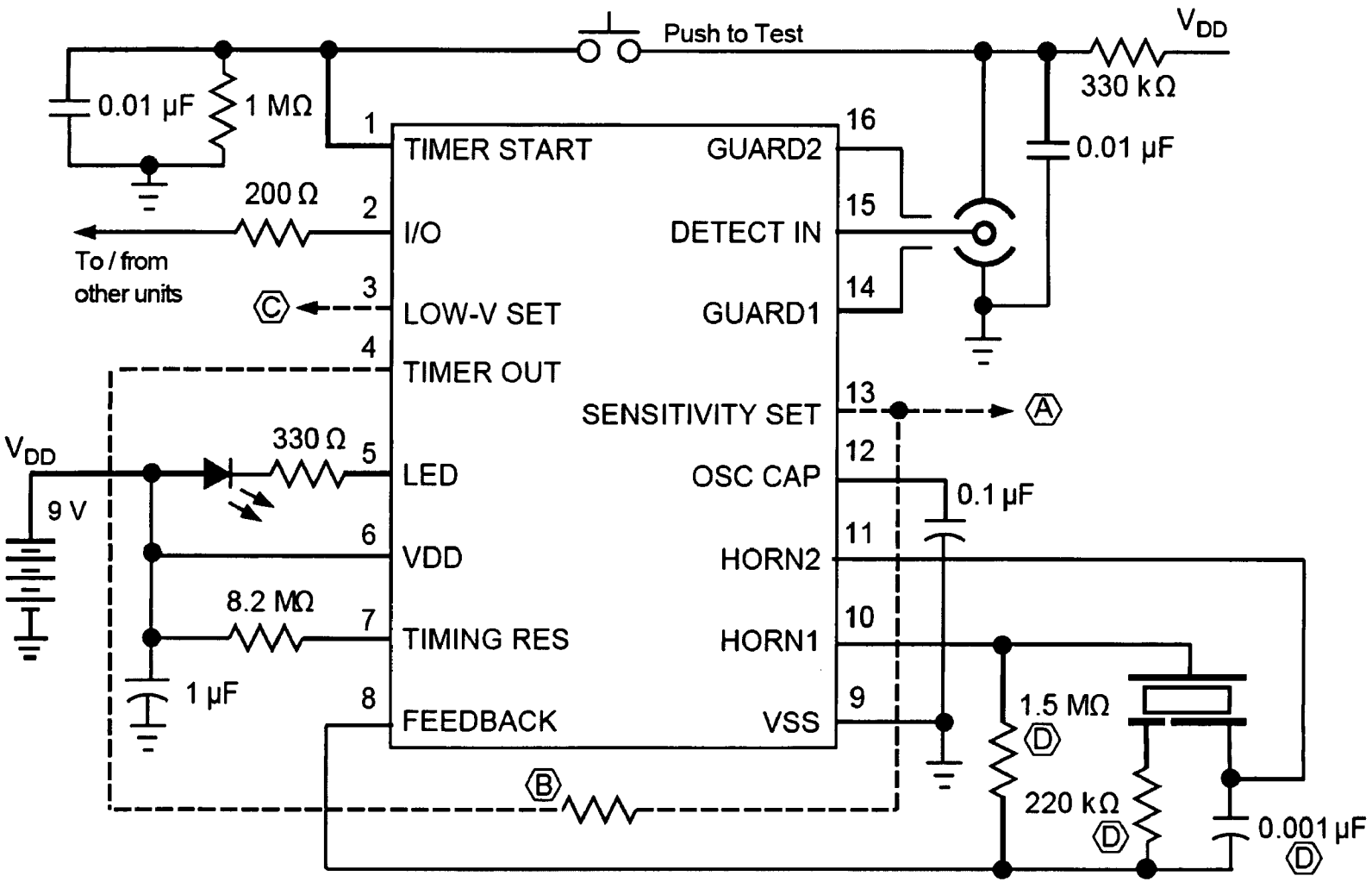
FIG. 3 is a diagram illustrating an integrated circuit according to an embodiment of the invention.

In at least one embodiment of the invention, represented by the diagram illustrated in FIG. 3, the alarm units include a low-current, integrated circuit (IC) providing all of the required features for an ionization-type smoke detector. A networking capability allows multiple alarm units (e.g., 125) to be interconnected so that if any alarm unit senses a hazardous condition all of the interconnected alarm units will sound their respective audible alert. In addition, features are incorporated to facilitate alignment and testing of the alarm units. The IC is designed for use in hazardous condition alarm units that comply with UL 217.

Consistent with the requirements of UL 217, the internal oscillator and timing circuitry keep standby power to a minimum by powering down the IC (e.g., for 1.66 seconds) and sensing for a hazardous condition (e.g., for only 10 ms). A check is made (e.g., every 24 on-off cycles) for a low battery condition. By substituting other types of sensors or a switch for the ionization detector, this very-low-power IC can be used in numerous other battery-operated safety/security applications.

FIG. 3 illustrates the IC according to at least one embodiment, having a 16-pin dual in-line plastic package (DIP). It is rated for continuous operation over the temperature range of 0° C. to 50° C. The Pb (lead) free version (suffix-T) has 100% matte tin leadframe plating.

Figure 4:
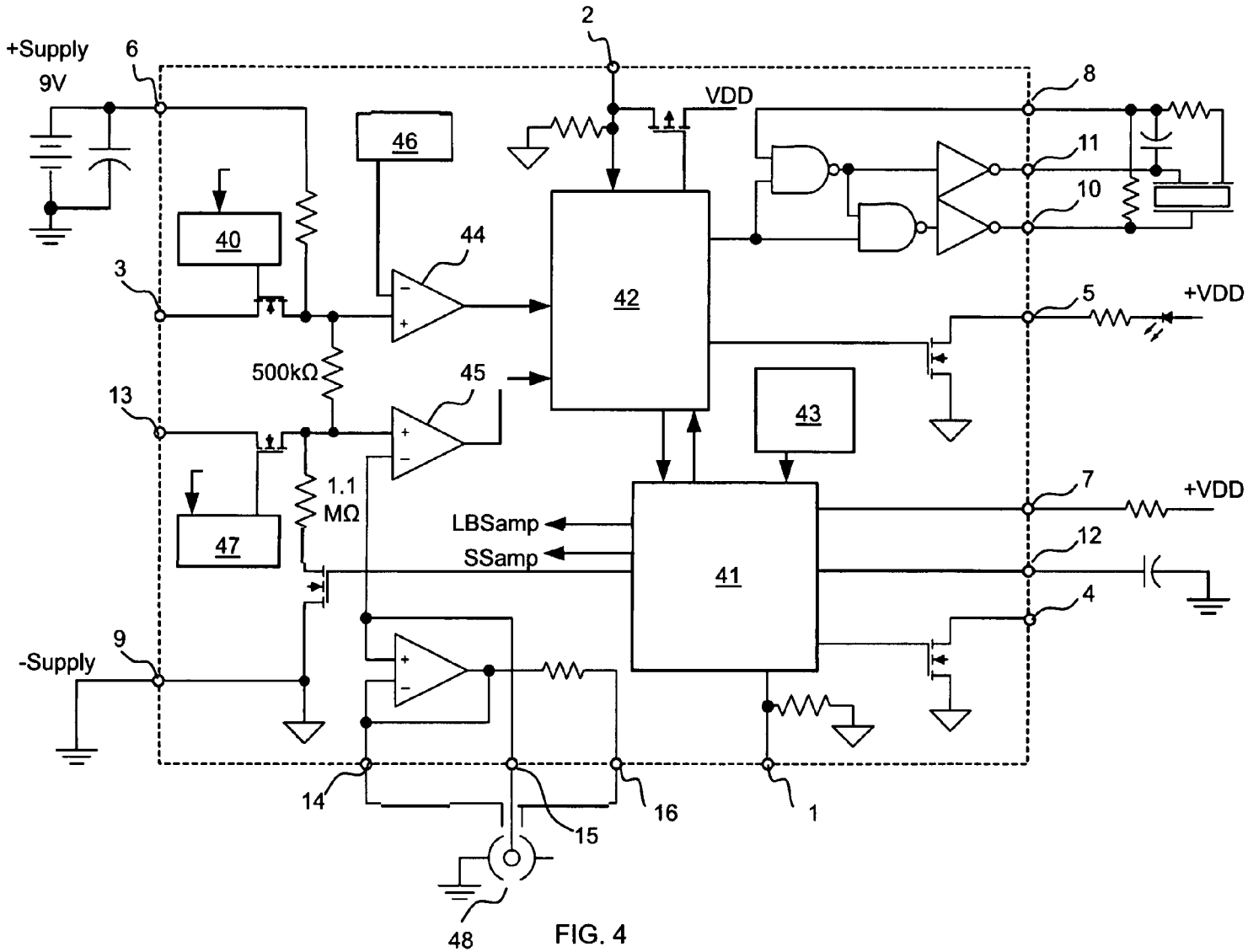
FIG. 4 is a functional diagram illustrating the integrated circuit of FIG. 3.

Terminal 1 (also referred to herein as the "TIMER START pin" or "pin 1") provides an input to start the reduced sensitivity timer mode. Moreover, terminal 7 (also referred to herein as the "TIMING RES pin" or "pin 7") provides a terminal for the timing resistor and sets the internal bias to affect timing. The TIMER OUT pin is also referred to herein as the "terminal 4" or "pin 4" and is used with a resistor to adjust sensitivity during the timer mode. As illustrated in FIG. 4, the TIMER START pin is operatively connected to the GUARD2 and TIMEROUT pins. The TIMING RES pin is operatively connected to the LED and OSC CAP pins; and, the TIMER OUT pin is operatively connected to the TIMER START and OSC CAP pins.

Terminal 2 (also referred to herein as the "I/O pin" or "pin 2") provides an input/output (I/O) terminal to the interconnected alarm units. As illustrated in FIG. 4, the I/O pin is operatively connected to the FEEDBACK and VDD pins. A connection to the I/O pin allows multiple alarm units to be interconnected. If any single alarm unit detects a hazardous condition, its I/O pin is driven high (e.g., after a nominal 3 second delay), and all interconnected alarm units sound their respective horns. When the I/O pin is driven high by another alarm unit, the oscillator speeds up (e.g., to its 40 ms period), and two consecutive clock cycles with I/O sampled high trigger an audible alert. This filtering provides significant immunity to I/O noise. The flashing light source is suppressed when an audible alert is signaled from an interconnected alarm unit, and any local alarm condition causes the I/O pin to be ignored as an input. When in timer mode, the IC signals an audible alert if I/O is driven high externally. An internal n-channel metal-oxide-semiconductor field-effect transistor (NMOS) device acts as a charge dump to aid in applications involving a large (distributed) capacitance on the I/O pin, and is activated at the end of a local alarm. This pin has an on-chip pulldown device and is left unconnected if not used.

As described above, when multiple alarm units are interconnected through the I/O line, the actuatable latch allows a person to identify which alarm unit or alarm units initiated an audible alert. When a local alarm condition occurs, the triggering alarm unit sounds its horn and latches the event in memory. The networked, non-triggering alarm units also sound their horns, but do not latch the event in memory. An alarm unit does not latch an alarm condition if it was the result of a push-to-test event. After the alarm condition clears and all alarm units have stopped sounding their horns, a person identifies the initiating devices by depressing the test switch on any of the interconnected alarm units, which makes the I/O pin go high immediately and all interconnected alarm units begin to sound their horns. When the person releases the test switch (e.g., within 10 seconds), all of the horns turn off, except for the horn on the triggering alarm unit, which continues to sound its horn (e.g., for 60 more seconds).

The light source of a triggering alarm unit with an actuatable latch in the latched state behaves the same as an alarm unit with an actuatable latch in the unlatched state. A person resets all of the actuatable latches to the unlatched state in the network of interconnected alarm units by depressing the reset switch on any of the interconnected alarm units (e.g., for 10 seconds).

Terminal 3 (also referred to herein as the "LOW-V SET pin" or "pin 3") is used with a resistor to adjust the low battery threshold. As illustrated in FIG. 4, the LOW-V SET pin is operatively connected to the VDD pin, the SENSITIVITY SET pin, and a low battery sample component 40.

Terminal 5 (also referred to herein as the "LED pin" or "pin 5") provides an output to drive the flashing light source. As illustrated in FIG. 4, the LED pin is operatively connected to the HORN1 and TIMING RES pins. An internal oscillator and timing component 41 operates with a period (e.g., 1.67 seconds) when a hazardous condition is not present. Internal power is applied to the entire IC (e.g., for 10 ms) and a check is made for a hazardous condition (e.g., every 1.67 seconds). The oscillator and timing component 41 is operatively connected to the logic component 42 and the power-on reset component 43. Because very-low currents are used in the IC, the oscillator capacitor at the OSC CAP pin is a low-leakage type (PTFE, polystyrene, or polypropylene). The OSC CAP pin (also referred to herein as the "terminal 12" or "pin 12") provides a terminal for charging/discharging an external capacitor to run the oscillator. As illustrated in FIG. 4, the OSC CAP pin is operatively connected to the TIMING RES and TIMER OUT pins.

Terminal 6 (also referred to herein as the "VDD pin" or "pin 6") provides a positive supply voltage; Terminal 9 (also referred to herein as the "VSS pin" or "pin 9") provides a negative supply voltage. As illustrated in FIG. 4, the VDD pin is operatively connected to the I/O and LOW-V SET pins; and, the VSS pin is operatively connected to the SENSITIVITY SET and GUARD1 pins.

Terminal 8 (also referred to herein as the "FEEDBACK pin" or "pin 8") provides an input for driving a piezoelectric horn. As illustrated in FIG. 4, the FEEDBACK pin is operatively connected to the I/O and HORN2 pins. On power-up, all internal counters are reset. All functional tests are accelerated by driving the OSC CAP pin (e.g., with a 2 kHz square wave). The strobe period (e.g., 10 ms) is maintained for proper operation of the comparator circuitry (i.e., the low battery comparator 44 and smoke comparator 45). The low battery comparator 44 is operatively connected to the band gap 46 component.

Terminal 10 (also referred to herein as the "HORN1 pin" or "pin 10") provides an output for driving the piezoelectric horn; terminal 11 (also referred to herein as the "HORN2 pin" or "pin 11") provides a complementary output for driving the piezoelectric horn. As illustrated in FIG. 4, the HORN1 pin is operatively connected to the HORN2 and LED pins; and, the HORN2 pin is operatively connected to the HORN1 and FEEDBACK pins. If a hazardous condition is detected, the oscillator period changes (e.g., to 40 ms) and the horn is enabled. The horn output follows a temporal horn pattern, e.g., nominally 0.5 s on, 0.5 s off, 0.5 s on, 0.5 s, 0.5 s on, 1.5 s off. During the off-time, the alarm unit checks for a hazardous condition and further output from the alarm unit is inhibited if a hazardous condition is not sensed. Upon detection of a hazardous condition, the low-battery alarm is inhibited and the light source is pulsed (e.g., once every second).

Terminal 13 (also referred to herein as the "SENSITIVITY SET pin" or "pin 13") is used with a resistor to adjust the sensitivity for a specific chamber. Terminal 15 (also referred to herein as the "DETECT IN pin" or "pin 15") provides an input from the detector chamber. As illustrated in FIG. 4, the SENSITIVITY SET pin is operatively connected to the LOW-V SET pin, the VSS pin and a smoke sample component 47; and, the DETECT IN pin is operatively connected to the GUARD1 and GUARD2 pins. When the voltage on the DETECT IN pin is less than the voltage on the SENSITIVITY SET pin, the IC evaluates this as a detected hazardous condition. When a hazardous condition is detected, the resistor divider network that sets the sensitivity is altered to increase VSENSITIVITYSET (e.g., by 230 mV) with no external connections on the SENSITIVITY SET pin. This provides hysteresis and reduces false triggering.

An active guard is provided on GUARD1 and GUARD2, the two pins adjacent to the detector input, and the DETECT IN pin. Terminal 14 (also referred to herein as the "GUARD1 pin" or "pin 14") provides an active guard1 for the detector input; and, terminal 16 (also referred to herein as the "GUARD2 pin" or "pin 16") provides an active guard2 for the detector input. As illustrated in FIG. 4, the GUARD1 pin is operatively connected to the VSS and DETECT IN pins; and, the GUARD2 pin is operatively connected to the DETECT IN and TIMER START pins. For example, the VGUARD1 and VGUARD2 pins are within 100 mV of VDETECTIN. This keeps surface leakage currents to a minimum and provides a method of measuring the input voltage without loading the ionization chamber 48. The active guard amplifier is not power strobed and thus provides constant protection from surface leakage currents. The detector input has internal diode protection against electrostatic damage.

Referring to FIG. 3, at point A, an external resistor is used to adjust the sensitivity for a particular smoke chamber. At point B, a resistor is selected to reduce sensitivity during the timer mode. A resistor to VSS or VDD may be added to the pin at point C to modify the low battery voltage threshold. The value of the component at point D will vary, based on the horn used, for example, a piezoelectric horn as indicated.

Figure 5A:
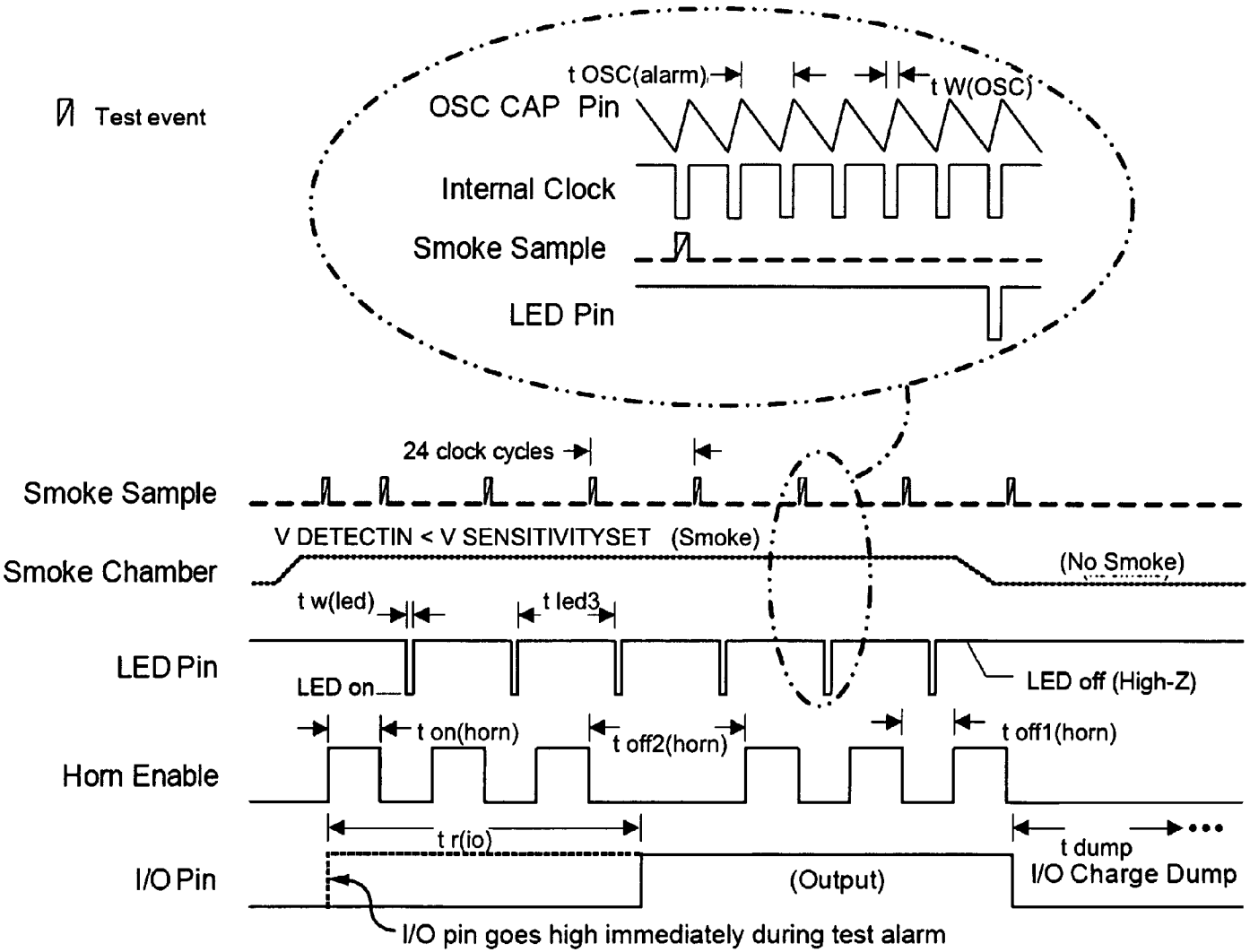
FIGS. 5A and 5B illustrate horn timing diagrams of a system according to an embodiment of the invention.
Figure 5B:
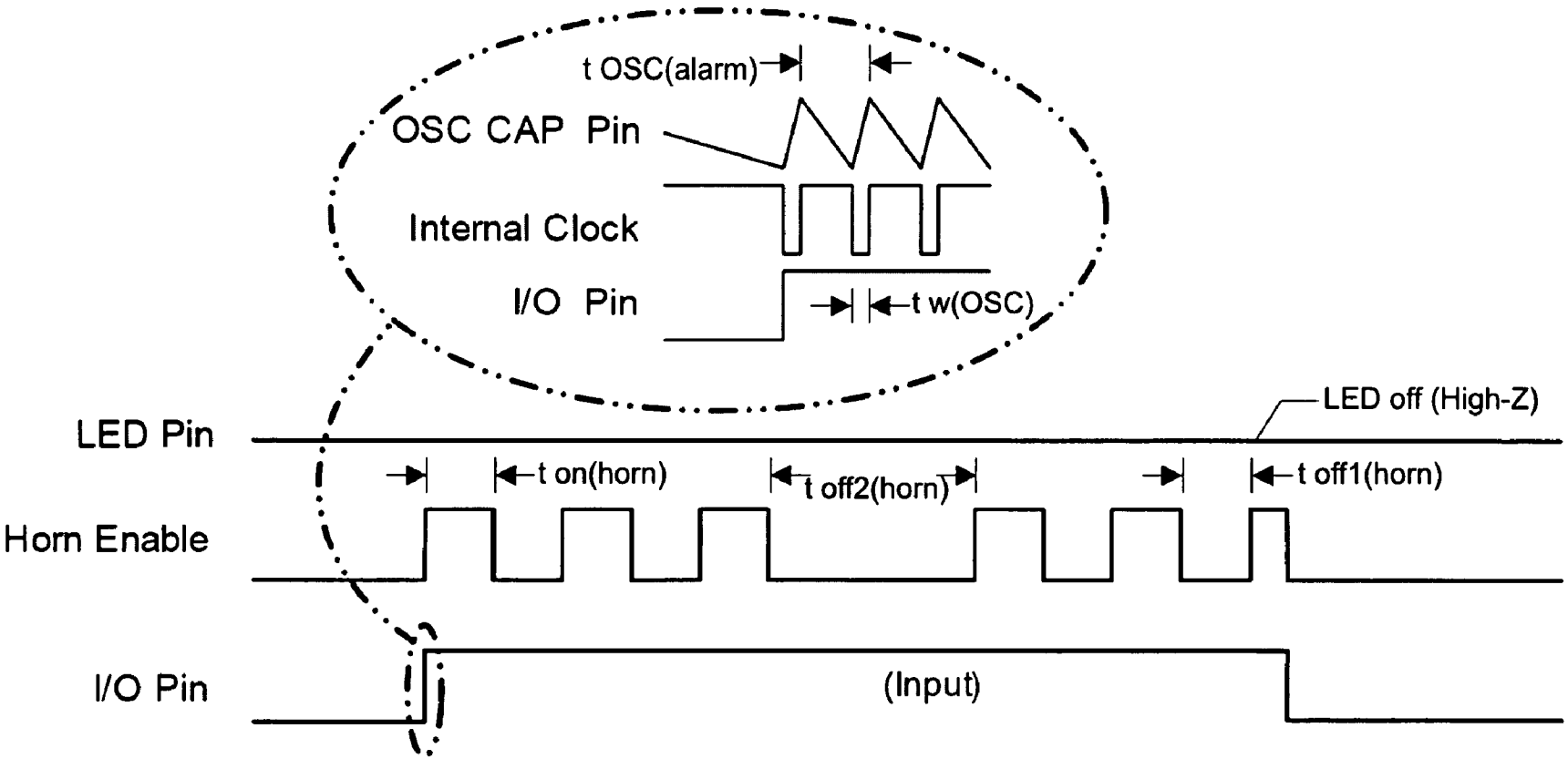

FIGS. 5A and 5B illustrate horn enable timing diagrams according to an embodiment of the invention. Specifically, FIG. 5A illustrates smoke sample, smoke chamber, LED pin, horn enable, and I/O pin timing diagrams during a local smoke detection/test alarm condition. FIG. 5B illustrates LED pin, horn enable, and I/O pin timing diagrams during a remote alarm condition.

In another embodiment of the invention, the alarm units include low power CMOS ionization type smoke detector ICs. With few external components, this IC provides all of the features of an ionization type smoke detector. An internal oscillator strobe powers the hazardous condition detection circuitry (e.g., for 10.5 mS every 1.66 seconds) to keep the standby current to a minimum. A check for a low battery condition is performed (e.g., every 40 seconds) when in standby. A charge dump feature quickly discharges the interconnect line when exiting a local alarm condition. Utilizing low power CMOS technology, the IC is used in hazardous condition detectors that comply with Underwriters Laboratory Specification UL 217, UL 268, and/or UL 2034.

Figure 6:
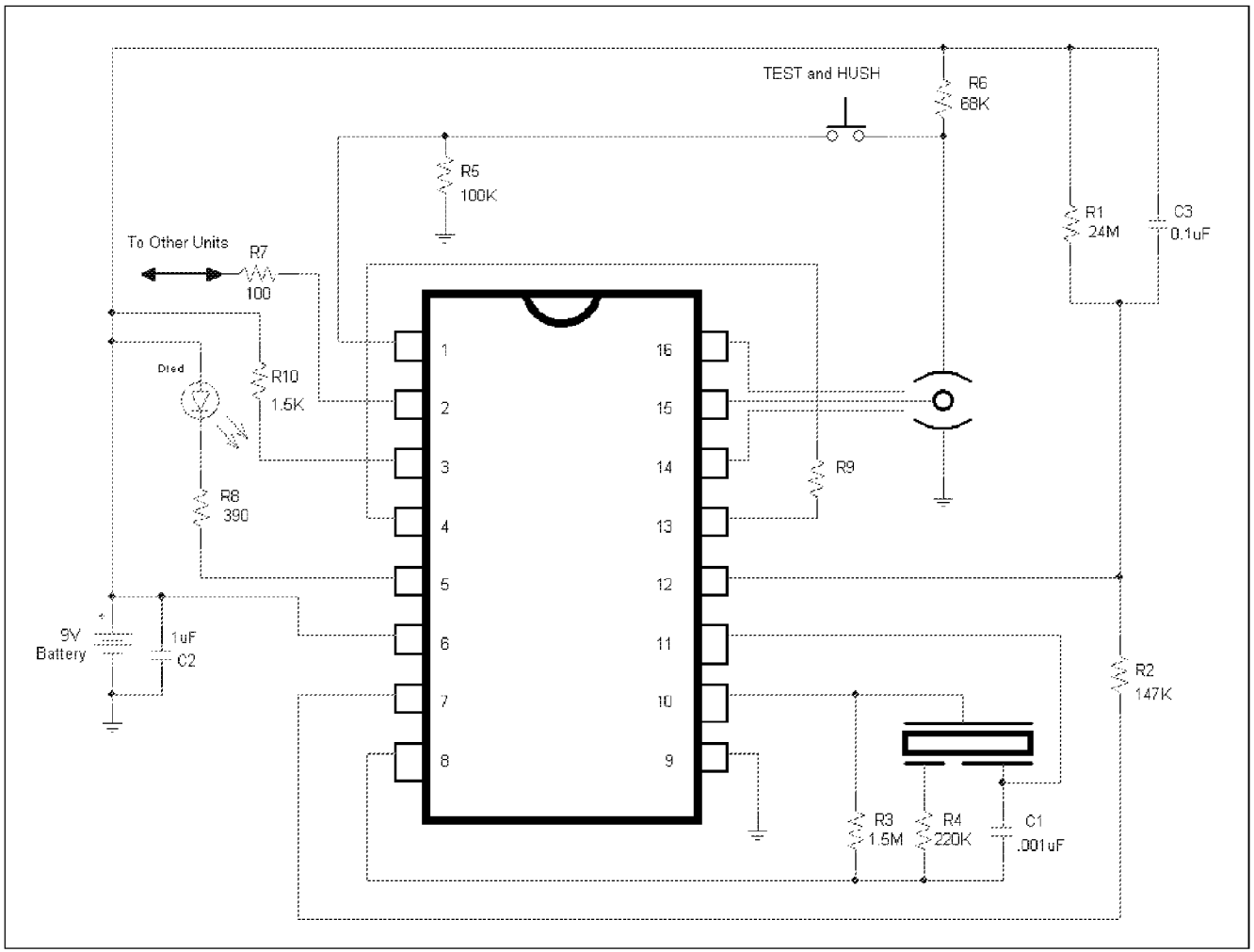
FIG. 6 is a diagram illustrating an integrated circuit according to an embodiment of the invention.

FIG. 6 is a diagram illustrating components of the IC according to an embodiment of the invention. The IC includes pin 1*b* (TSTART), pin 2*b* (I/O), pin 3*b* (TONE), pin 4*b* (TSTROBE), pin 5*b* (LED), pin 6*b* (VDD), pin 7*b* (ROSC), and pin 8*b* (FEED). The IC further includes pin 9*b* (VSS), pin 10*b* (HB), pin 11*b* (HS), pin 12*b* (COSC), pin 13*b* (VSEN), pin 14*b* (GUARD1), pin 15*b* (DETECT), and pin 16 (GUARD2).

If the unit is in local alarm (i.e., sounding its horn), then the transition of pin 1*b* from a high to low level resets the unit out of local alarm, activates the I/O charge dump feature, and initiates a timer. During this timer period (e.g., 12 minutes), the open drain NMOS on pin 4*b* is strobed on coincident with the internal clock. A resistor connected to this pin and pin 13*b* is used to modify the detector sensitivity during the timer period. During the timer period, the light source flashes (e.g., for 10.5 mS every 10 seconds). If the smoke level exceeds the reduced sensitivity set point during the timer period, the alarm unit goes into a local alarm condition (i.e., the horn sounds) and the timer mode is not cancelled. If an external only audible alert occurs during the timer mode, the timer mode is not cancelled. If the test switch is pushed in a standby, reduced sensitivity mode, the alarm unit is tested normally. Upon release of the test switch, the timer mode counter is reset and restarted. Once the timer is activated, it is reset by loss of power to the IC or after the timer times out.

Figure 7:
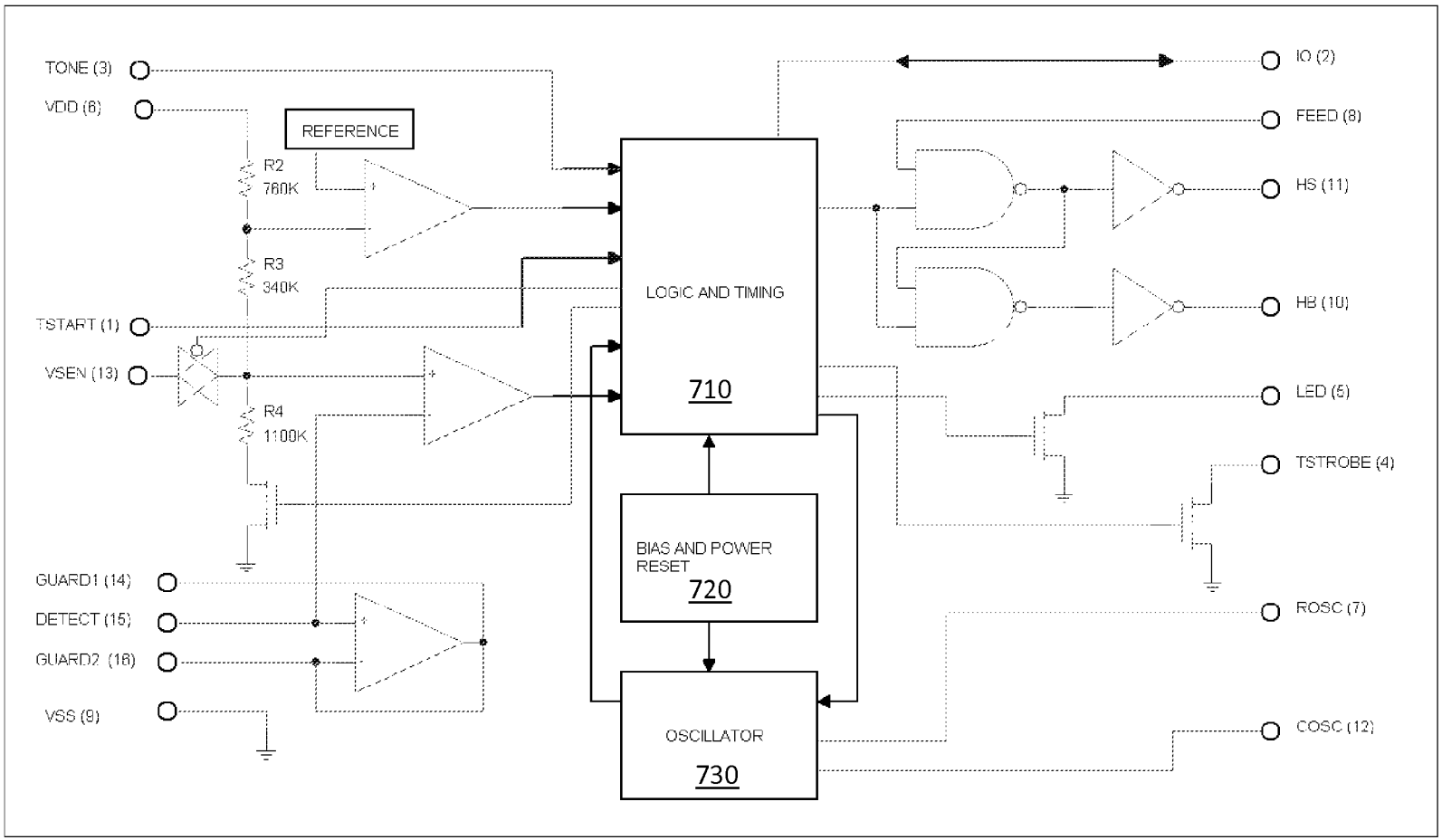
FIG. 7 is a functional block diagram of a system according to an embodiment of the invention.

The smoke comparator compares the ionization chamber voltage to a voltage derived from a resistor divider across VDD. This divider voltage is available externally on pin 13*b*. When a hazardous condition is detected, this voltage is internally increased (e.g., by 230 mV nominal) to provide hysteresis and make the detector less sensitive to false triggering. Pin 13*b* is used to modify the internal set point for the hazardous condition comparator by use of external resistors to VDD or VSS. Nominal values for the internal resistor divider are indicated in FIG. 7. For example, these internal resistor values vary by up to ±20% but the resistor matching is <2% on any one IC. A transmission switch on VSEN prevents any interaction from the external adjustment resistors.

The guard amplifier and outputs are active and are within, for example, 50 mV of the DETECT input (pin 15*b*) to reduce surface leakage. The guard outputs (pins 14*b* and 16*b*) also allow for measurement of the DETECT input without loading the ionization chamber.

Pin 2*b* provides the capability to common many alarm units in a single interconnected network. If a single alarm unit detects a hazardous condition, the pin 2*b* is driven high. This high signal causes the interconnected alarm units to activate their respective horns. The light source flashes (e.g., LED pulsed every 1 second for 10.5 mS) on the triggering alarm unit and is inhibited on the alarm units that are in alarm due to the I/O signal (i.e., the non-triggering alarm units). An internal sink device on the pin 2*b* helps to discharge the interconnect line. This charge dump device is active for 1 clock cycle after the unit exits the alarm condition (e.g., 1.67 seconds). The interconnect input has a digital filter (e.g., 500 mS nominal). This allows for interconnection to other types of alarm units (e.g., CO) that may have a pulsed interconnect signal.

Pin 3*b* selects the NFPA72 horn tone (high) or the ⅔ duty cycle continuous tone (low). If pin 3*b* is externally connected high, a current limiting resistor (e.g., of at least 1.5 K) from pin 3*b* to VDD is used. The IC internally limits the current from VSS to VDD in the event of accidental polarity reversal. If an input is connected to VDD, the connection is made through a resistance (e.g., of at least 1.5 K) to limit the reverse current through this path. Pin 6*b* is the VDD pin; and, pin 9*b* is the VSS pin.

In the low battery detection mode, an internal reference is compared to the voltage divided VDD supply. The battery is checked under load via the light source low side driver output since low battery status is latched at the end of the light source pulse (e.g., 10.5 mS). For example, an LED is pulsed on for 10.5 mS every 40 seconds in standby; in alarm mode, the LED is pulsed on for 10.5 mS every 1 second. Pin 5*b* is the LED pin.

Pin 7*b* is the ROSC pin; and, pin 12*b* is the COSC pin. For example, the period of the oscillator is nominally 1.67 seconds in standby, wherein every 1.66 seconds, the detection circuitry is powered up for 10.5 mS and the status of the smoke comparator is latched. The LED driver is turned on (e.g., for 10.5 mS) and the status of the low battery comparator is latched (e.g., every 40 seconds). The smoke comparator status is not checked during the low battery test, during the low battery horn warning chirp, or when the horn is on due to a detected hazardous condition. If a hazardous condition is detected, the oscillator period increases (e.g., to 20.5 mS). The oscillator period is mainly determined by the values of R1, R2, and C3. For example, the oscillator period $T=TR+TF$, where $TR=0.69\times R1\times C3$ in standby and $TR=0.69\times(R1/R2)\times C3$ in alarm, $TF=0.69\times R2\times 3$.

At power up, all internal registers are reset. The low battery set point is tested at power up by holding FEED low and COSC high at power up. Pin 8*b* is the FEED pin. HB changes state as VDD passes through the low battery set point. Pin 10*b* is the HB pin; and, pin 11*b* is the HS pin. By holding pin 12*b* high the internal power strobe is active. Functional testing is accelerated by driving pin 12*b* (e.g., with a 4000 HZ square wave); however, the strobe period (e.g., 10.5 mS) is maintained for proper operation of the analog circuitry.

FIG. 7 is a functional block diagram of a system according to an embodiment of the invention, including a logic and timing block 710, a bias and power reset block 720, and an oscillator block 730. Pins 1*b*, 2*b*, 3*b*, 4*b*, 5*b*, 6*b*, 8*b*, 9*b*, 10*b*, 11*b*, 13*b*, 14*b*, 15*b*, and 16*b* are connected to the logic and timing block 710. Pins 7*b* and 12*b* are connected to the oscillator block 730. The bias and power reset block 720 is connected to the logic and timing block 710 and the oscillator block 730.

Figure 8A:
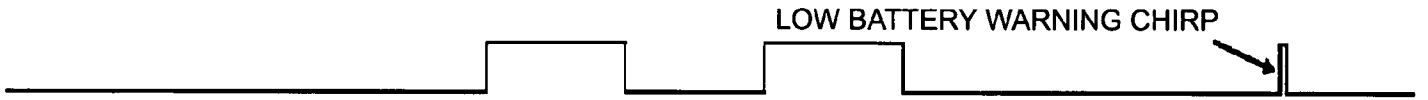
FIGS. 8A-8D illustrate horn timing diagrams of a system according to an embodiment of the invention.
Figure 8B:
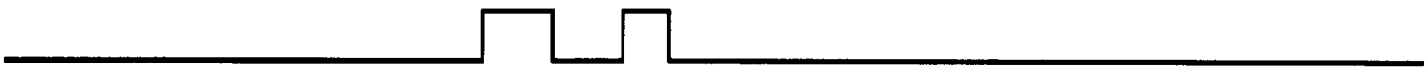
Figure 8C:
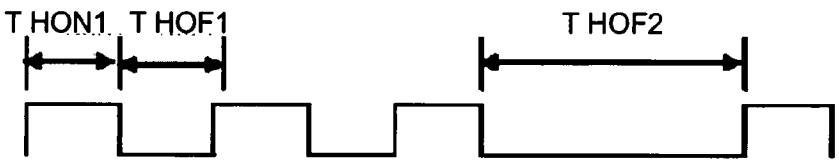
Figure 8D:
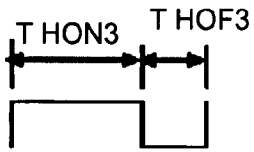

FIGS. 8A-8D illustrate horn timing diagrams according to an embodiment of the invention. Specifically, FIGS. 8A and 8B illustrate incomplete horn timing diagrams. The select hazardous condition is not sampled when the horn is active. In FIG. 8B, the start of the horn temporal pattern is not synchronized to an external alarm. The horn pattern is not self completing for the external alarm. The horn cycle is self completing in the local alarm. FIG. 8C illustrates a complete temporal horn pattern; and, FIG. 8D illustrates a complete continuous horn pattern.

Figure 9:
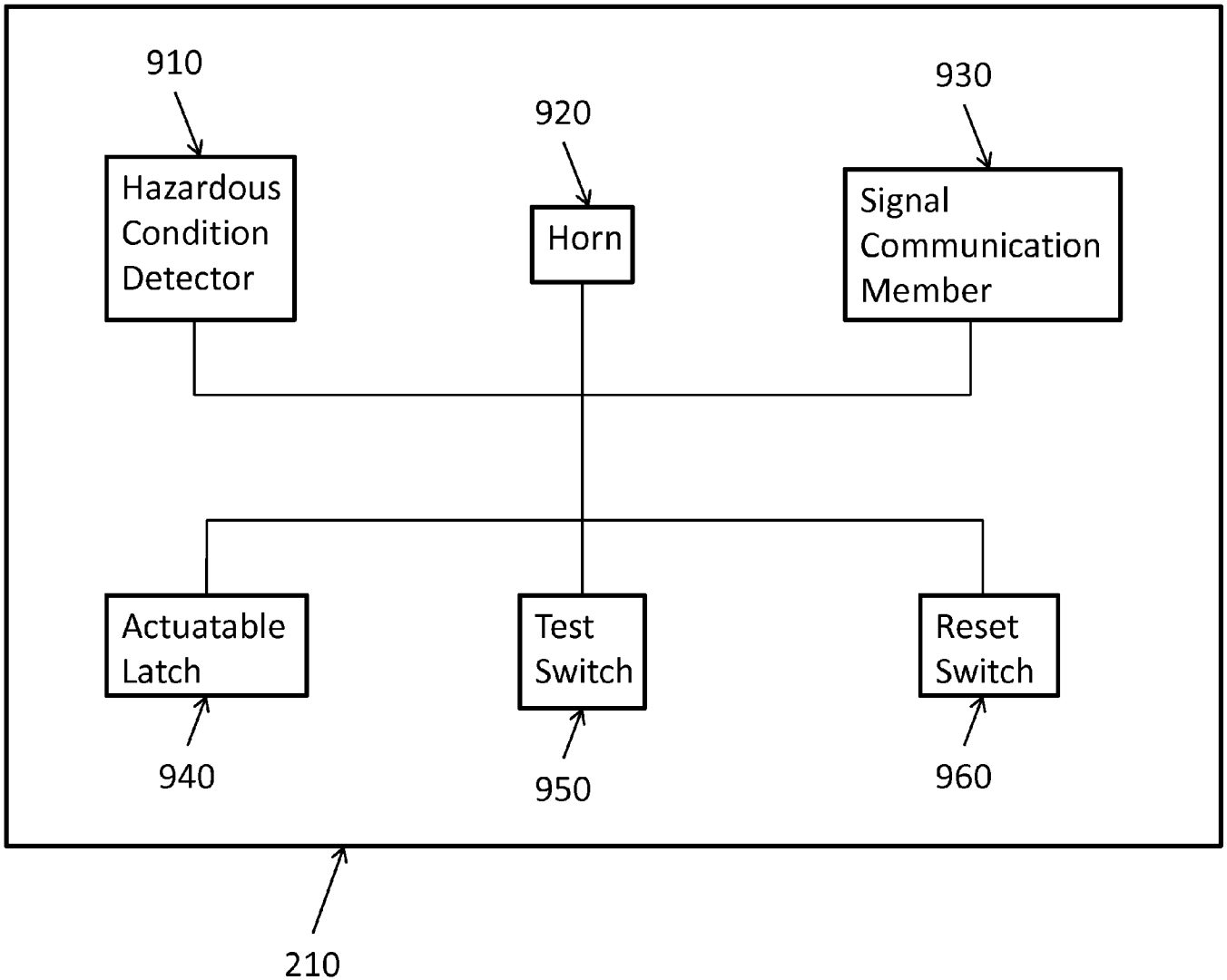
FIG. 9 is a diagram illustrating an individual alarm unit according to an embodiment of the invention.

In at least one embodiment of the invention, each hazardous condition alarm unit includes at least one hazardous condition detector 910, a horn 920, a signal communication member 930, an actuatable latch 940, a test switch 950, and a reset switch 960. A preferred embodiment of the alarm unit 210 is illustrated in FIG. 9.

The horn 920 generates an audible alert in response to detection of a select hazardous condition by the alarm unit 210, 220, 230, 240, and/or 250. The audible alert conforms to mandated patterns established by regulation or standard, e.g., UL 217. Moreover, the audible alert remains active in the alarm units having the actuatable latch in the latched state (i.e., the triggering alarm unit) after the select hazardous condition has been eliminated.

The signal communication member 930 communicates a signal between the alarm units 210, 220, 230, 240, and 250. The signal is sent through an interconnect line in response to detection of the select hazardous condition. The signal causes activation of the respective horns in the alarm units 210, 220, 230, 240, and 250. The actuatable latch 940 is switchable between an unlatched state and a latched state. The latched state is established in response to the detection of the select hazardous condition by the triggering alarm unit.

The test switch 950 is switchable between a first position and a second position. The second position of the test switch 950 disables the horn in each alarm unit 210, 220, 230, 240, and 250 having an actuatable latch in the unlatched state (i.e., the non-triggering alarm units). As such, if an alarm unit did not detect a select hazardous condition, and therefore did not switch its respective actuatable latch to a latched state, then the test switch 950 would disable the horn of that alarm unit. Each alarm unit 210, 220, 230, 240, and 250 having an actuatable latch in the latched state (the triggering alarm units) is unaffected by the test switch for a predetermined period of time following actuation of the test switch (e.g., 60 seconds). In other words, the alarm unit that detected the select hazardous condition continues to sound an audible alert, while the alarm units that did not detect the select hazardous conditions are silenced. During this test period, a person can audibly locate the triggering alarm unit although vision may be impaired by walls and/or other visual obstructions. As contemplated herein, actuation of the test switch 950 does not affect the sensitivity in the non-triggering alarm units. Thus, although the horns are disabled in the non-triggering alarm units by actuation of the test switch 950, the sensitivity of the hazardous condition detectors remains the same throughout the alarm origination test.

The reset switch 960 resets the actuatable latch in every alarm unit 210, 220, 230, 240, and 250 to the unlatched state. As described above, actuating a reset switch in any of the alarm units 210, 220, 230, 240, and 250 resets the actuatable latches in all of the alarm units 210, 220, 230, 240, and 250. Although FIG. 9 illustrates the test switch 950 and the reset switch 960 as separate elements, it is contemplated in another embodiment, that a single switch is provided. For example, in such an embodiment, a test function is performed when the switch is held down and released within 10 seconds; and, a reset function is performed when the switch is held down for 10 seconds or more. The reset function is also applicable during an actual emergency condition when a hazardous condition is detected.

In another embodiment, the alarm units 210, 220, 230, 240, and 250 each have a visual alert. For instance, the alarm unit 210 has a visual alert 970. The visual alerts are generated in the alarm units 210, 220, 230, 240, and 250 in response to a select hazardous condition detected by any of the alarm units 210, 220, 230, 240, and 250. During an alarm origination test, actuation of any of the test switches in the alarm units 210, 220, 230, 240, and 250 disables the visual alert of each alarm unit 210, 220, 230, 240, and 250 having an actuatable latch in the unlatched state (i.e., the non-triggering alarm units).

In yet another embodiment, actuation of a test switch in any of the alarm units 210, 220, 230, 240, and 250 activates a secondary alert in all of the alarm units 210, 220, 230, 240, and 250. The secondary alert (e.g., bell) is different from the audible alert (e.g., buzzer) to differentiate an alarm origination test (secondary alert) from a hazardous alarm condition (audible alert). Subsequent release of the test switch disables the secondary alert in each alarm unit 210, 220, 230, 240, and 250 having an actuatable latch in the unlatched state (i.e., the non-triggering alarm units).

Other modifications and alterations may be used in the implementation and use of the latching concept of the present invention without departing from the spirit and scope thereof.

While described herein as a hardwire system, the invention is equally employable in an array of interconnected wireless units where the interconnect is provided through appropriate and known RF communication protocol.

What is claimed is:

1. A selective hazardous condition detector, comprising:

a) means for interconnecting said selective hazardous condition detector to a second selective hazardous condition detector;

b) means for detecting a select hazardous condition;

c) means for generating an alarm signal corresponding to a detected select hazardous condition;

d) memory means for recognizing said alarm signal;

e) latch means switchable between an unlatched state and a latched state, said latched state being established in response to said alarm signal and said latched state existing for a preset time period;

f) means for selectively actuating said memory means and switching said latch means to said latched state; and g) actuatable reset means for resetting the state of said latch means;

h) whereupon actuating said latch reset means switches said latch means from the latched to the unlatched state after said preset time period while switching the latched means to said unlatched state immediately in said second selective hazardous condition detector.

2. The detector according to claim 1, wherein said alarm signal is active in said selective hazardous condition detector during said preset time period, and wherein said alarm signal is inactive in said second selective hazardous condition detector during said preset time period.

3. The detector according to claim 1, wherein said alarm signal remains active in said selective hazardous condition detector after said select hazardous condition has been eliminated.

4. The detector according to claim 1, wherein said alarm signal comprises an audible alert.

5. The detector according to claim 4, wherein said audible alert corresponds to a select hazardous condition detected by said detector.

6. The detector according to claim 4, wherein said audible alert conforms to mandated patterns established by regulation.

7. A system comprising at least a first and a second interconnected hazardous condition alarm units, each of said alarm units comprising:

at least one hazardous condition detector;

a horn for generating an audible alert in response to detection of a select hazardous condition by at least one of said alarm units;

a signal communication member for communicating a signal between said at least first and second alarm units, said signal being sent in response to said detection of said select hazardous condition, and said signal causing activation of said horn;

an actuatable latch switchable between an unlatched state and a latched state, said latched state being established in response to said detection of said select hazardous condition;

a test switch switchable between a first position and a second position, said second position disabling a horn of each alarm unit of said alarm units comprising an actuatable latch in said unlatched state; and a reset switch for resetting said actuatable latch in every alarm unit of said alarm units to said unlatched state.

8. The system according to claim 7, wherein each alarm unit of said alarm units comprising said actuatable latch in said latched state is unaffected by said test switch for a predetermined period of time following actuation of said test switch.

9. The system according to claim 7, wherein said test switch and said reset switch are a common switch, and wherein each of said alarm units further comprises a visual alert generated in response to said detection of said select hazardous condition.

10. The system according to claim 9, wherein said test switch disables said visual alert of said each alarm unit of said alarm units comprising said actuatable latch in said unlatched state.

11. The system according to claim 7, wherein said test switch:

activates a secondary alert different from said audible alert in said alarm units; and disables said secondary alert in said each alarm unit of said alarm units comprising said actuatable latch in said unlatched state.

12. The system according to claim 7, wherein a threshold of sensitivity to said select hazardous condition remains unchanged upon actuation of said test switch to said second position.

13. The system according to claim 7, wherein said audible alert remains active in said each alarm unit of said alarm units comprising said actuatable latch in said latched state after said select hazardous condition has been eliminated.

14. A method comprising:

a) detecting a select hazardous condition by at least one triggering alarm unit of a plurality of interconnected hazardous condition alarm units;

b) switching an actuatable latch in said at least one triggering alarm unit from an unlatched state to a latched state;

c) generating an audible alert in said plurality of interconnected hazardous condition alarm units;

d) actuating a test switch to identify said at least one triggering alarm unit, said actuating of said test switch comprising disabling said audible alert in each alarm unit of said plurality of interconnected hazardous condition alarm units comprising an actuatable latch in said unlatched state; and e) actuating a reset switch in only one alarm unit of said plurality of interconnected hazardous condition alarm units to reset said actuatable latch in each of said plurality of interconnected hazardous condition alarm units to said unlatched state.

15. The method according to claim 14, wherein said generating of said audible alert comprises:

sending an alert signal from said at least one triggering alarm unit to an interconnect line connecting each of said plurality of interconnected hazardous condition alarm units;

receiving said alert signal by said plurality of interconnected hazardous condition alarm units; and in response to said receiving of said alert signal, activating said audible alert in said plurality of interconnected hazardous condition alarm units.

16. The method according to claim 14, wherein a threshold of sensitivity to said select hazardous condition remains unaffected by said actuation of said test switch.

17. The method according to claim 14, wherein said actuating of said test switch comprises unaffecting said audible alert in each alarm unit of said plurality of interconnected hazardous condition alarm units comprising an actuatable latch in said latched state.

18. The method according to claim 14, further comprising:

generating a visual alert in said plurality of interconnected hazardous condition alarm units; and disabling said visual alert in said each alarm unit of said plurality of interconnected hazardous condition alarm units comprising said actuatable latch in said unlatched state.

19. The method according to claim 14, further comprising:

generating a secondary alert different from said audible alert in said plurality of interconnected hazardous condition alarm units; and disabling said secondary alert in said each alarm unit of said plurality of interconnected hazardous condition alarm units comprising said actuatable latch in said unlatched state.

20. The method according to claim 14, further comprising maintaining said audible alert in said at least one triggering alarm unit after said select hazardous condition has been eliminated.

* * * * *